US011085723B2

(12) United States Patent
Kielsmeier

(10) Patent No.: US 11,085,723 B2
(45) Date of Patent: Aug. 10, 2021

(54) SELECTOR TRACK HAVING VARYING HEIGHTS AND REMOVABLE SELECTOR LEVER STOP

(71) Applicant: Magpul Industries Corp., Austin, TX (US)

(72) Inventor: Nicholas Kielsmeier, Denver, CO (US)

(73) Assignee: Magpul Industries Corp., Austin, TX (US)

( * ) Notice: Subject to any disclaimer, the term of this patent is extended or adjusted under 35 U.S.C. 154(b) by 269 days.

(21) Appl. No.: 16/395,401

(22) Filed: Apr. 26, 2019

(65) Prior Publication Data

US 2020/0340770 A1 Oct. 29, 2020

(51) Int. Cl.
*F41A 19/46* (2006.01)
*F41A 17/46* (2006.01)

(52) U.S. Cl.
CPC ..... *F41A 19/46* (2013.01); *F41A 17/46* (2013.01)

(58) Field of Classification Search
CPC ..... F41A 19/46; F41A 17/46; F41A 17/52; F41A 17/62; F41A 17/70; F41A 17/80; F41A 3/66
USPC ..... 42/70.06; 89/127, 128, 132, 142
See application file for complete search history.

(56) References Cited

U.S. PATENT DOCUMENTS 2,379,946 A * 7/1945 Baker ..... F41A 17/46 42/70.06
3,292,492 A 12/1966 Sturtevant
5,251,533 A 10/1993 Layton
5,623,114 A 4/1997 Soper
5,760,328 A 6/1998 Robbins
8,549,982 B2 * 10/2013 Troy, Jr. ..... F41A 35/06 89/132
8,661,722 B2 3/2014 Dionne et al.
8,752,321 B2 6/2014 Burress, Jr.
9,003,948 B2 4/2015 Brown
9,441,897 B2 9/2016 Mather et al.
9,562,733 B2 2/2017 Huther
9,791,233 B2 10/2017 Geissele
(Continued)

FOREIGN PATENT DOCUMENTS

WO 9742461 A1 11/1997

OTHER PUBLICATIONS

The High Road, "FAL Safety Question", "Retrieved from https://www.thehighroad.org/index.php?threads/fal-safety-question.112555/", Nov. 22, 2004, p. 2.
(Continued)

*Primary Examiner* — John Cooper
(74) *Attorney, Agent, or Firm* — Neugeboren O'Dowd PC

(57) ABSTRACT

This disclosure describes systems, methods, and apparatus for a firearm grip module having a selector track arcing concentrically around a selector lever aperture in one of two walls of the firearm grip module. The selector track can include multiple levels or heights, corresponding to different operating mode positions of the selector lever, where these different heights cause differing resistance to movement of the selector lever, where greater height equals greater resistance. The selector track may also include a safety indentation, a semi-auto indentation, and a full-auto indentation. The track may also include a removable, molded-in stop, between the semi-auto and full-auto indentations, which blocks the selector lever from overtraveling a standard fire position.

20 Claims, 15 Drawing Sheets

(56) References Cited

U.S. PATENT DOCUMENTS

| | | | | |
|---|---|---|---|---|
| 10,030,926 | B2 | 7/2018 | Mather et al. | |
| 10,126,081 | B1 | 11/2018 | Geissele | |
| D841,755 | S | 2/2019 | Pavlick | |
| 10,767,949 | B2 * | 9/2020 | Zung | F41A 19/46 |
| 2013/0111794 | A1 | 5/2013 | Dionne et al. | |
| 2015/0267984 | A1 * | 9/2015 | Kokinis | F41A 5/26 42/14 |
| 2018/0087860 | A1 | 3/2018 | Sullivan et al. | |
| 2018/0100712 | A1 | 4/2018 | Tompkins | |
| 2018/0142979 | A1 | 5/2018 | Troy et al. | |

OTHER PUBLICATIONS

Major Rob Robinette, "M16 4-Way Selector Install", "Retrieved from https://robrobinette.com/M16_4-Way_Selector.htm", Known to exist as early as Apr. 3, 2019, p. 9.

Heckler & Koch, Inc. International Training Division, "MP-5 Armorers Instruction", Mar. 1, 2002, p. 71, Publisher: Heckler and Koch, Inc., Published in: US.

Multiple Authors, "How To: Field Strip, Replace Extractor & Ejector Lever (Fixed)", "Retrieved from https://www.ar15.com/forums/Armory/How-to-Field-Strip-Replace-Extractor-and-Ejector-Lever-FIXED-/9-241315/", Apr. 9, 2008, p. 74.

Heckler & Koch, Inc., "Heckler & Koch MP5 Submachine Gun Family: Operator's Manual—Draft-", May 25, 2001, p. 17, Published in: US.

Nicholas C, "H&K MP5: What Does S/E/F Mean?", "Retrieved from https://www.thefirearmblog.com/blog/2017/02/08/hk-mp5-sef-mean/", Feb. 8, 2017, p. 3.

Heckler & Koch Inc., "Brief Description of the MP 5 SF Submachine Gun", Jan. 29, 2007, p. 11, Publisher: Heckler and Koch, Inc., Published in: DE.

Nathaniel F, "A Short Discussion on AR-15 and AK Safety Levers", "Retrieved from https://www.thefirearmblog.com/blog/2016/12/30/short-discussion-ar-15-ak-safety-levers/", Dec. 30, 2016, p. 6.

Beaufume, Cedric, "Extended European Search Report Regarding Application No. 20168975.9", dated Jan. 14, 2021, p. 10, Published in: EP.

* cited by examiner

SELECTOR TRACK HAVING VARYING HEIGHTS AND REMOVABLE SELECTOR LEVER STOP

FIELD OF THE DISCLOSURE

The present disclosure relates generally to a firearm grip module. More specifically, but without limitation, the present disclosure relates to a raised selector track having different heights for different operational modes of the firearm as well as a molded-in selector stop.

DESCRIPTION OF RELATED ART

A fire control selector refers to the system employed in a weapon to control the operation and firing mode of the weapon. Traditionally, the fire control selector allows a user to switch between a plurality of fire modes, such as safe, where the weapon will not fire, a semi-automatic mode, where the weapon will fire one round each time the trigger is pulled, sometimes a burst mode, where the weapon will fire some predetermined number of rounds each time the trigger is pulled, and/or a fully automatic mode, where a trigger pull causes the weapon to fire continuously until either the trigger is released, or the ammunition runs out. The weapon often has a left and right side and a bore that traverses through the left and right sides. A shaft traverses the bore and has a first end and a second end that are spaced from each other in opposing relation. A lever couples to either the first end or the second end of the shaft and extends along the left side or the right side of the firearm.

Typically, a user's thumb actuates the lever of the fire control switch. Actuation of the lever results in rotation of the shaft. The shaft can possess a plurality of camming surfaces set between the first end and the second end to facilitate firing of the firearm. As such, based on the orientation of the camming surfaces, the firearm operates according to the fire mode selected.

In the case of an MP5-type weapon, the lever can be rotated into a safe position, where a portion of the shaft blocks movement of the trigger. This in turn prevents the disengagement of the sear from the sear notch on the hammer, thus preventing the weapon from firing should the trigger be pulled, or the weapon dropped.

The shaft may also include a sear disconnect that prevents the weapon from firing more than one round in the semi-automatic mode of fire. The sear ensures that even if the trigger is held rearward after the round is fired the sear will catch the hammer and prevent it from riding forward on the bolt carrier where it could possibly strike the firing pin again.

During normal operation, the MP5 receiver prevents inadvertent placement of the selector lever into the disassembly position. However, this interface could suffer from tolerance stacking between the selector lever back through the grip module and into the receiver. Thus, there is a need for a more consistent, robust, and high-tolerance means to prevent the selector lever from moving into the disassembly position during normal MP5 operation.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as a firearm grip module including an operational mode selector lever, a first and second wall forming a channel therebetween, a selector lever aperture in the first wall, and a selector track. The channel can be configured to receive a trigger assembly and each of the first and second walls can have an outer surface. The selector lever aperture can be arranged in the first wall. The selector track can arc concentrically around the selector lever aperture. The selector track can include a first portion of the track having a first height from the outer surface of the first wall. The selector track can also include a second portion of the track having a second height from the outer surface of the first wall. The selector track can also include a third portion of the track having a third height from the outer surface of the first wall. The selector track can also include a fourth portion of the track having a fourth height from the outer surface of the first wall. The fourth height can be greater than the first height and the second height can be greater than the first height.

The first wall can either be a left or right side of the firearm grip module. In some embodiments, a selector lever track can be arranged on both left and right walls of the firearm grip module.

The fire mode selector lever can include a movable detent. The raised selector track can include a safety indentation arranged between the first and fourth portions of the track, and shaped to receive at least a portion of the movable detent. The raised selector track can also include a semi-auto indentation arranged between the first and second portions of the track, and shaped to receive at least a portion of the movable detent. The raised selector track can also include a full-auto indentation arranged on the third portion of the track and shaped to receive at least a portion of the movable detent. The raised selector track may also include a removable molded-in stop arranged at least partially between the second and third portions of the track.

Other embodiments of the disclosure may also be characterized as a firearm grip module including a first and second wall forming a channel therebetween, a selector lever aperture in the first wall, and a selector track. The channel can be configured to receive a trigger assembly and each of the first and second walls can have an outer surface. The selector lever aperture can be arranged in the first wall. The selector track can arc concentrically around the selector lever aperture. The selector track can include a first portion of the track having a first height from the outer surface of the first wall. The selector track can also include a second portion of the track having a second height from the outer surface of the first wall. The selector track can also include a third portion of the track having a third height from the outer surface of the first wall. The selector track can also include a fourth portion of the track having a fourth height from the outer surface of the first wall. The fourth height can be greater than the first height and the second height can be greater than the first height.

The first wall can either be a left or right side of the firearm grip module. In some embodiments, a selector lever track can be arranged on both left and right walls of the firearm grip module.

The fire mode selector lever can include a movable detent. The raised selector track can include a safety indentation arranged between the first and fourth portions of the track, and shaped to receive at least a portion of the movable detent. The raised selector track can also include a semi-auto indentation arranged between the first and second portions of the track, and shaped to receive at least a portion of the movable detent. The raised selector track can also include a full-auto indentation arranged on the third portion of the track and shaped to receive at least a portion of the movable detent. The raised selector track may also include a removable molded-in stop arranged at least partially between the second and third portions of the track.

Other embodiments of the disclosure can be characterized as a method of converting a firearm grip module from semi- to full-auto capability. The method can include removing a first mode selector lever from the firearm grip module. The method can further include removing a semi-auto trigger assembly from the firearm grip module. The method can further include cutting or abrading a removable molded-in stop arranged atop a selector track to form a smooth transition between a semi-auto indentation in the track and a full-auto indentation in the track. The method can yet further include coupling a full-auto trigger assembly into the firearm grip module and coupling a second mode selector lever into the full-auto trigger assembly.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

The word "exemplary" is used herein to mean "serving as an example, instance, or illustration." Any embodiment described herein as "exemplary" is not necessarily to be construed as preferred or advantageous over other embodiments.

The present disclosure relates generally to a firearm grip module. More specifically, but without limitation, the present disclosure relates to a raised selector track having different heights for different operational modes of the firearm as well as a molded-in selector stop.

Preliminary note: the flowcharts and block diagrams in the following Figures illustrate the architecture, functionality, and operation of possible implementations of systems, methods and computer program products according to various embodiments of the present invention. In this regard, some blocks in these flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

Traditionally, the same torque is applied to move a selector lever between safe, semi-auto, full-auto, and disassembly positions. However, it is desirable to present the user with differing amounts of resistance depending on the operational mode that a selector lever is being moved into, for instance greater resistance to move into a full-auto or disassembly position. Accordingly, this disclosure describes a raised selector track 102 having two or more different heights, where a greater height causes more resistance to movement of the selector lever 124 (see FIG. 5).

Figure 5:
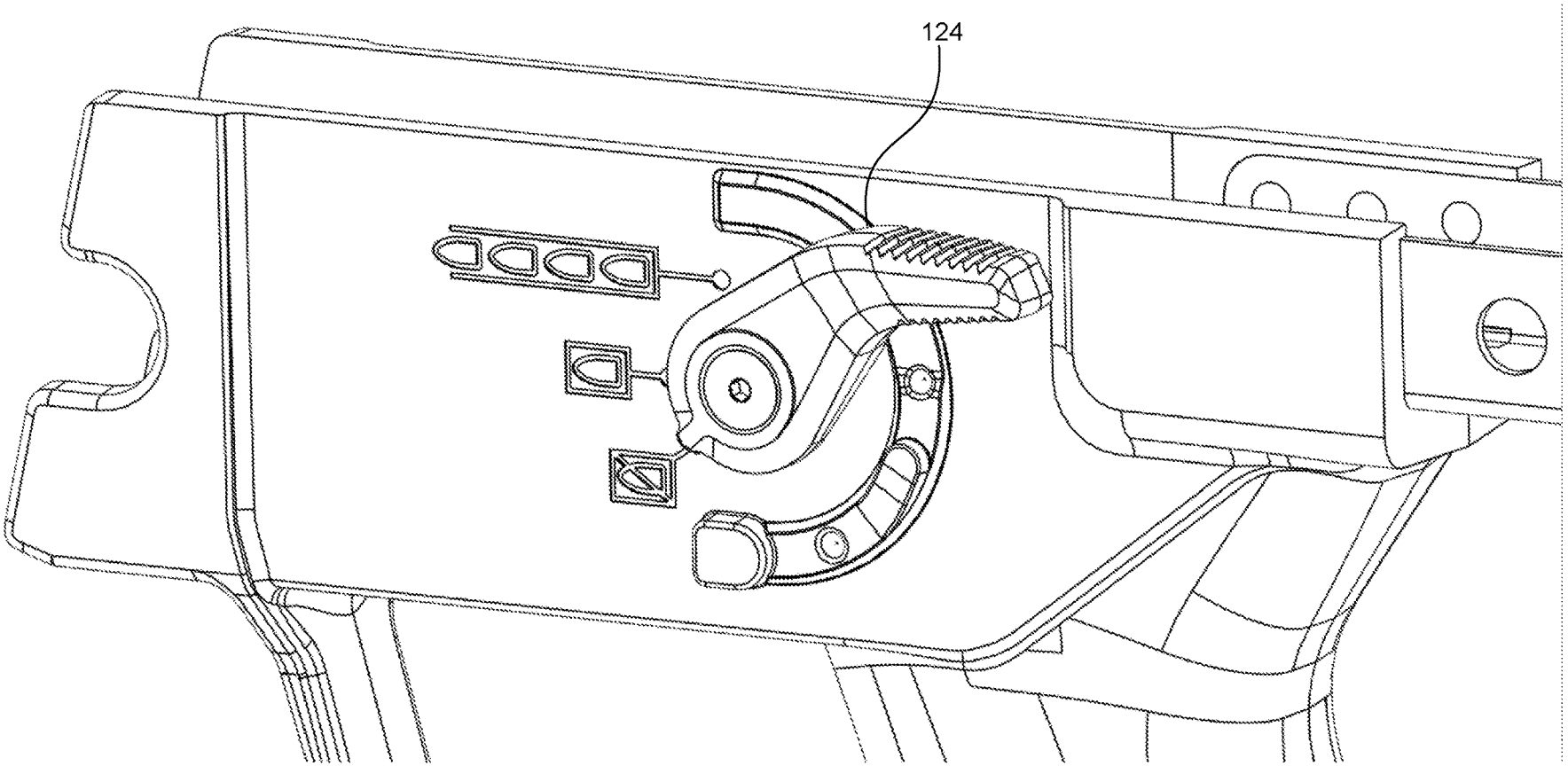
FIG. 5 illustrates the grip module with an operational mode selector lever in a safe position.

Specifically, the grip module 100 can include an optional operational mode selector lever 124 (see FIG. 5). The operational mode selector lever 124 (or selector lever) can include a shaft 134 (see FIG. 7) that passes through a selector lever aperture 122 in a first wall 101 and/or a second wall 103. In other words, the operational mode selector lever 124 can be arranged on either side of the grip module 100, and in some embodiments, two operational mode selector levers 124 can be implemented—one on each side of the grip module 100. The first and second walls can form a channel therebetween configured to receive a trigger assembly. Each of the walls 101, 103 can have a respective outer surface 105, 107.

The grip module 100 can include a raised selector track 102 that includes a first portion 108, a second portion 112, a third portion 116, and a fourth portion 104. The track 102 can also include a safety indentation 106, a semi-auto indentation 110, and a full-auto indentation 118. The operational mode selector lever 124 can rotate between the indentations 106, 110, 118 via the first, second, and third portions 108, 112, 116 and can move into the fourth portion 104 for disassembly.

Figure 6:
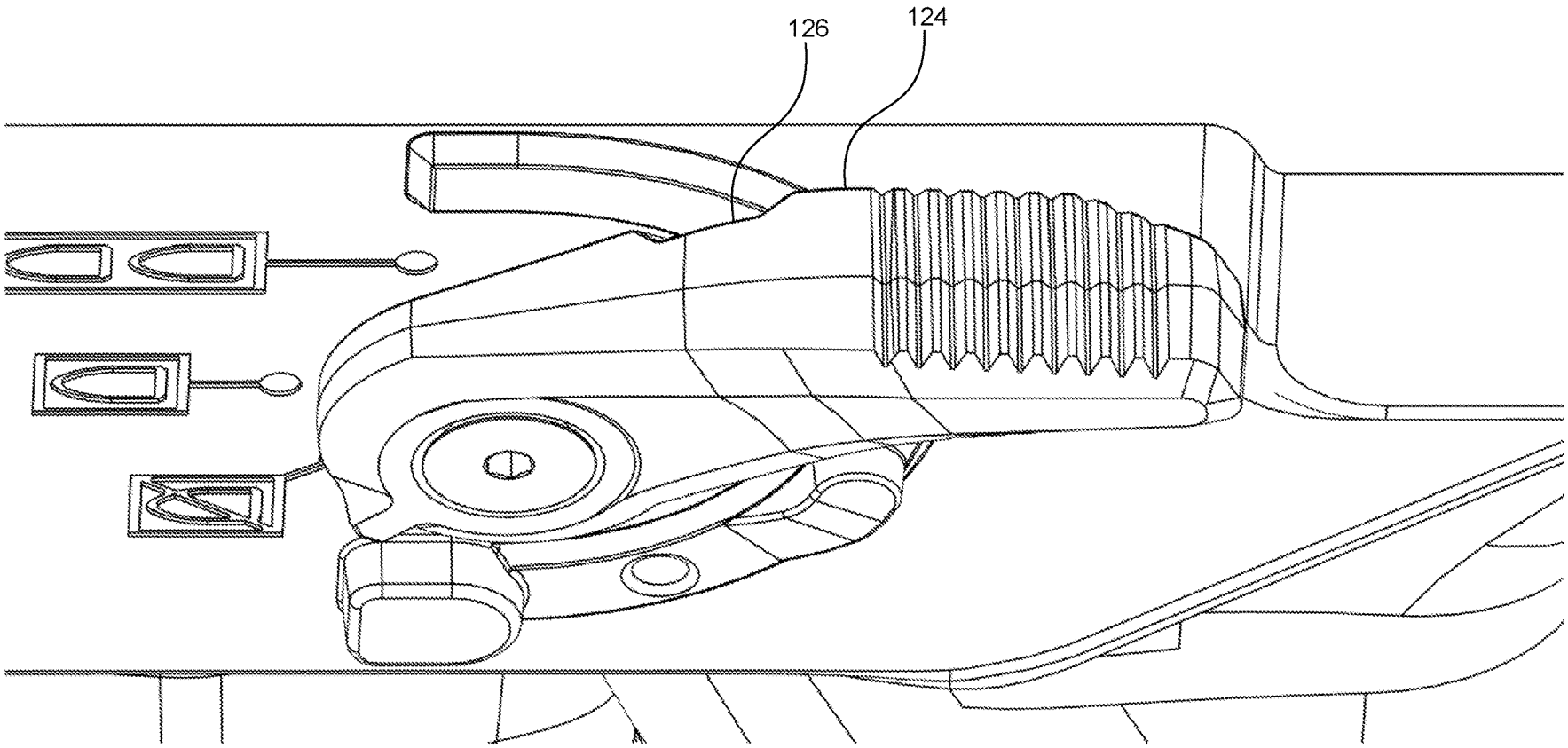
FIG. 6 illustrates another angle of the operational mode selector lever of FIG. 5, showing a track recess in the lever shaped to mimic a cross section of the track.

To illustrate the different positions of the lever 124, reference is first made to FIGS. 5-6 showing the lever 124 arranged in a safety position where a movable detent 130 of the lever 124 is engaged with the safety indentation 106.

Figure 9:
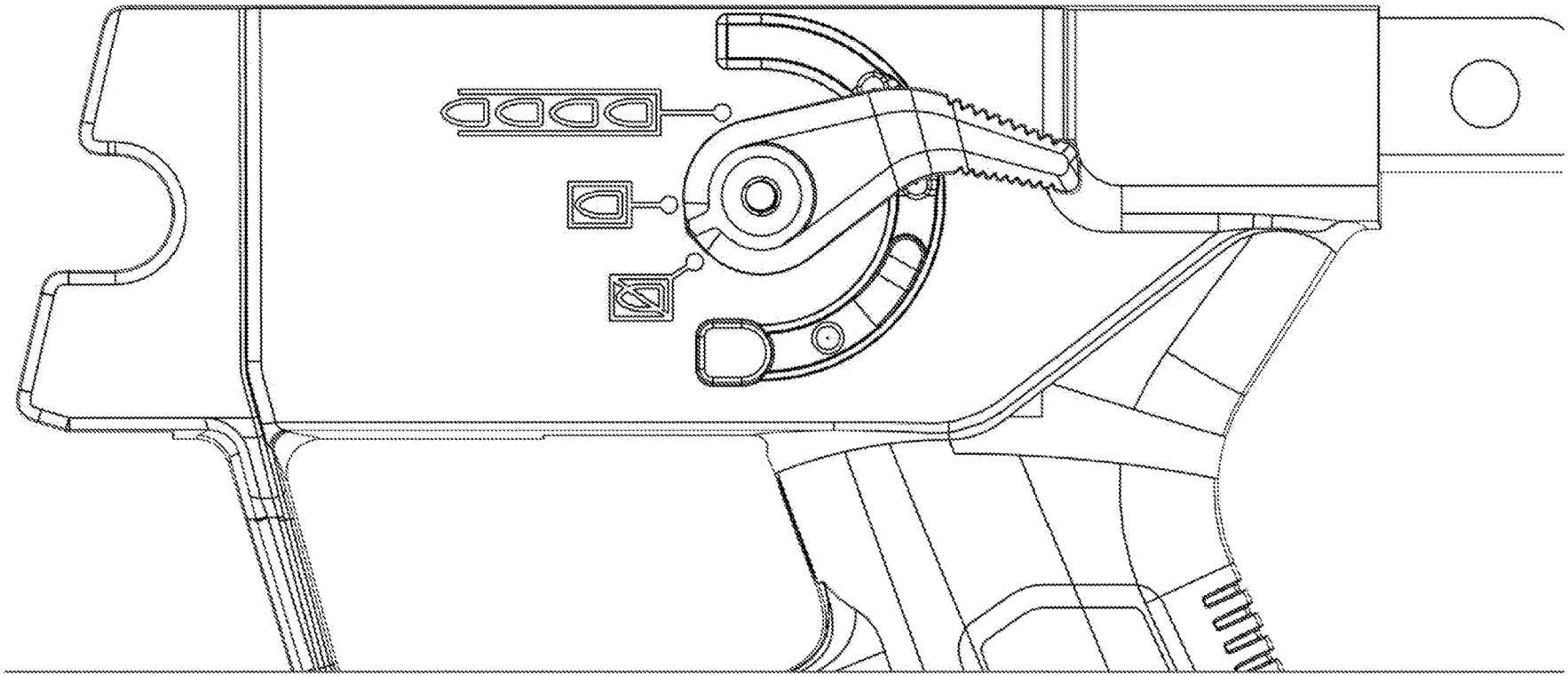
FIG. 9 illustrates the grip module with the operational mode selector lever in between the safe and semi-auto positions.

FIG. 9 shows the lever 124 arranged over the first portion 108, in between the safety and semi-auto indentations 106, 110, and where the movable detent 130 is not engaged with any indentations.

Figure 10:
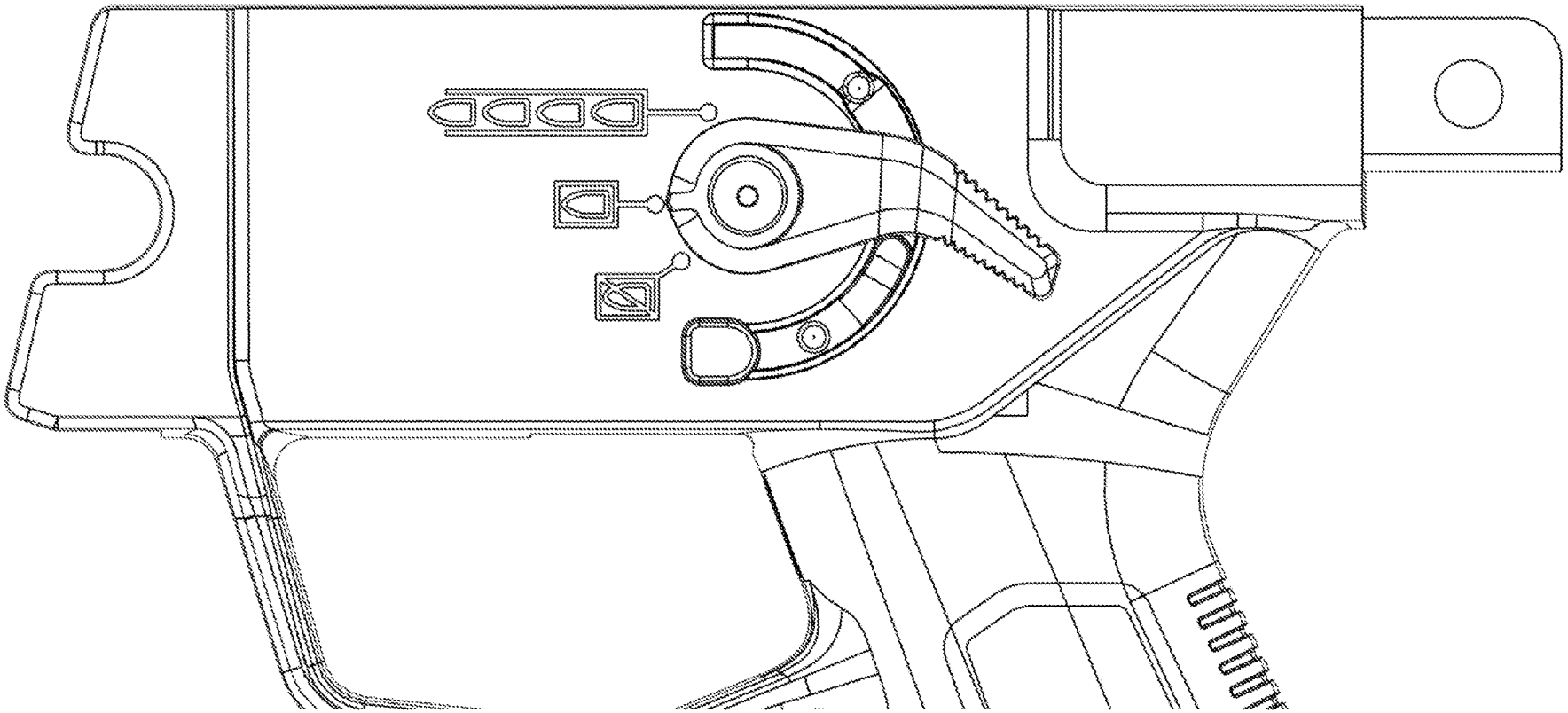
FIG. 10 illustrates the grip module with the operational mode selector lever in the semi-auto position.

FIG. 10 shows the lever 124 in the semi-auto position where the movable detent 130 is engaged with the semi-auto indentation 110. FIG. 10 also shows the lever 124 butting up against the removable molded-in stop 114.

Figure 11:
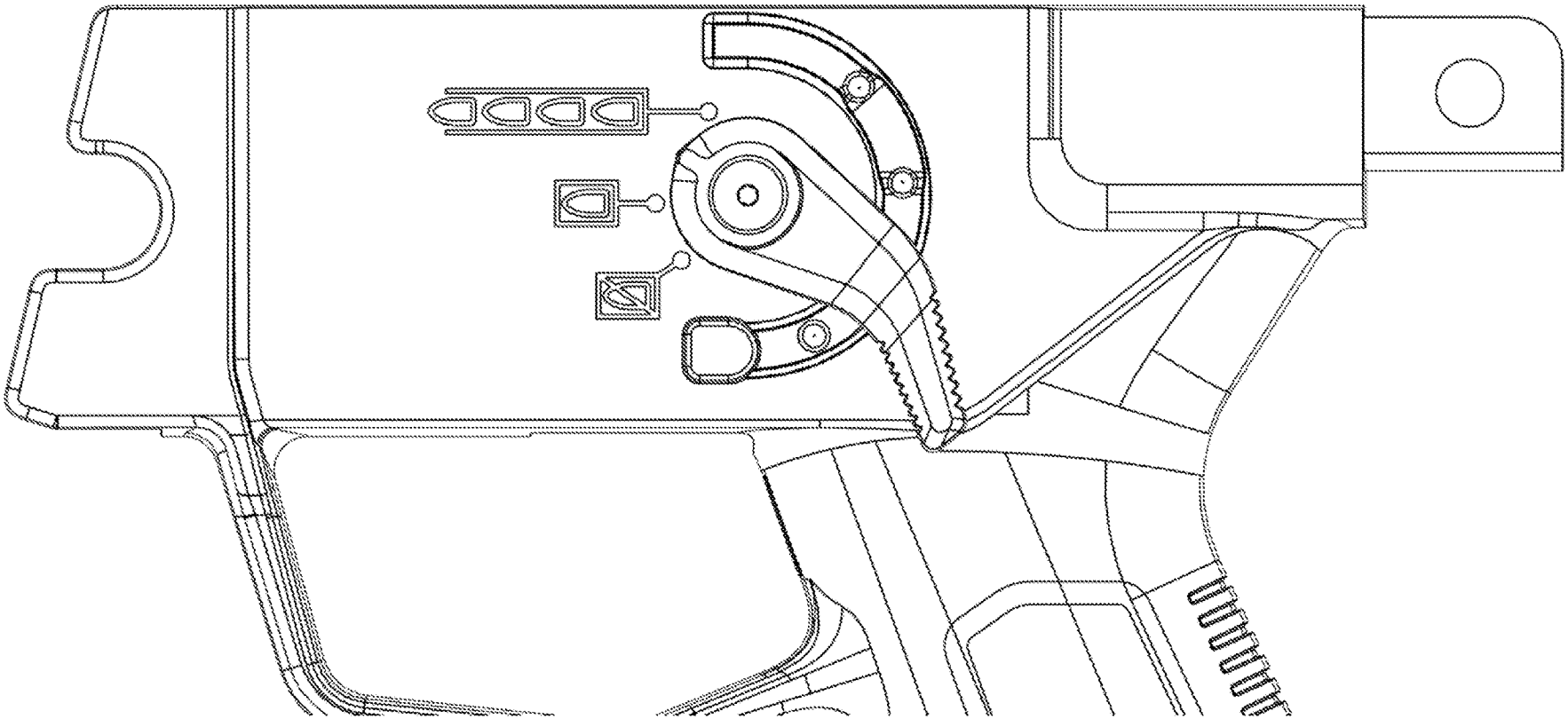
FIG. 11 illustrates a grip module with the removable molded-in stop removed and the operational mode selector lever in between the semi- and full-auto positions.

FIG. 11 shows a configuration where the removable molded-in stop 114 has been removed, and where the lever 124 is arranged over the second and third portions of the track 112, 116 between the semi-auto and full-auto indentations 110, 116. The movable detent 130 is not engaged with any indentations in this position.

Figure 12:
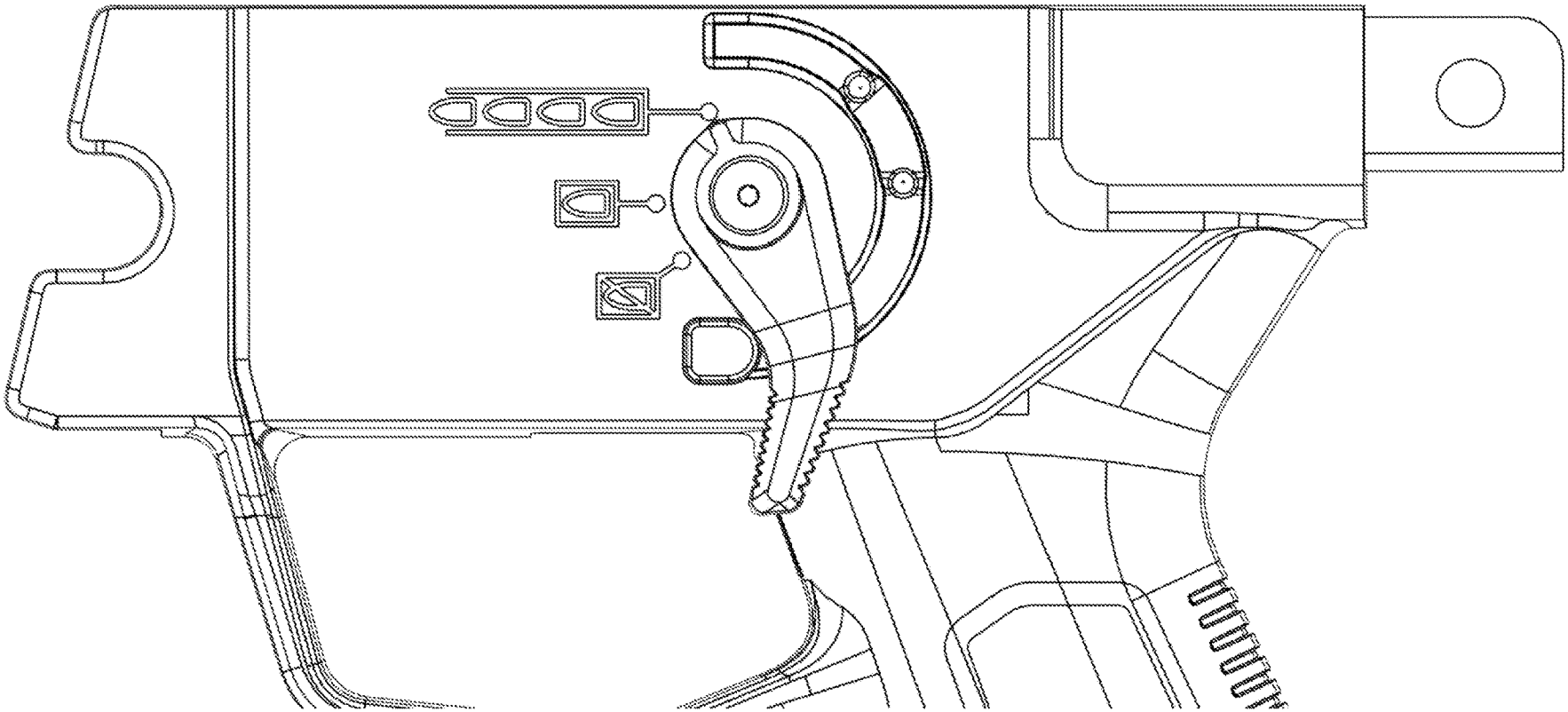
FIG. 12 illustrates the grip module with the operational mode selector lever in the full-auto position.

FIG. 12 shows the lever 124 in the full-auto position where the moveable detent 130 is engaged with the full-auto indentation 118. FIG. 12 also shows the lever 124 butted up against a molded-in full-auto stop 120 at a lower end of the track 102. This stop 120 can extend above a tallest height of the track 102.

Figure 14:
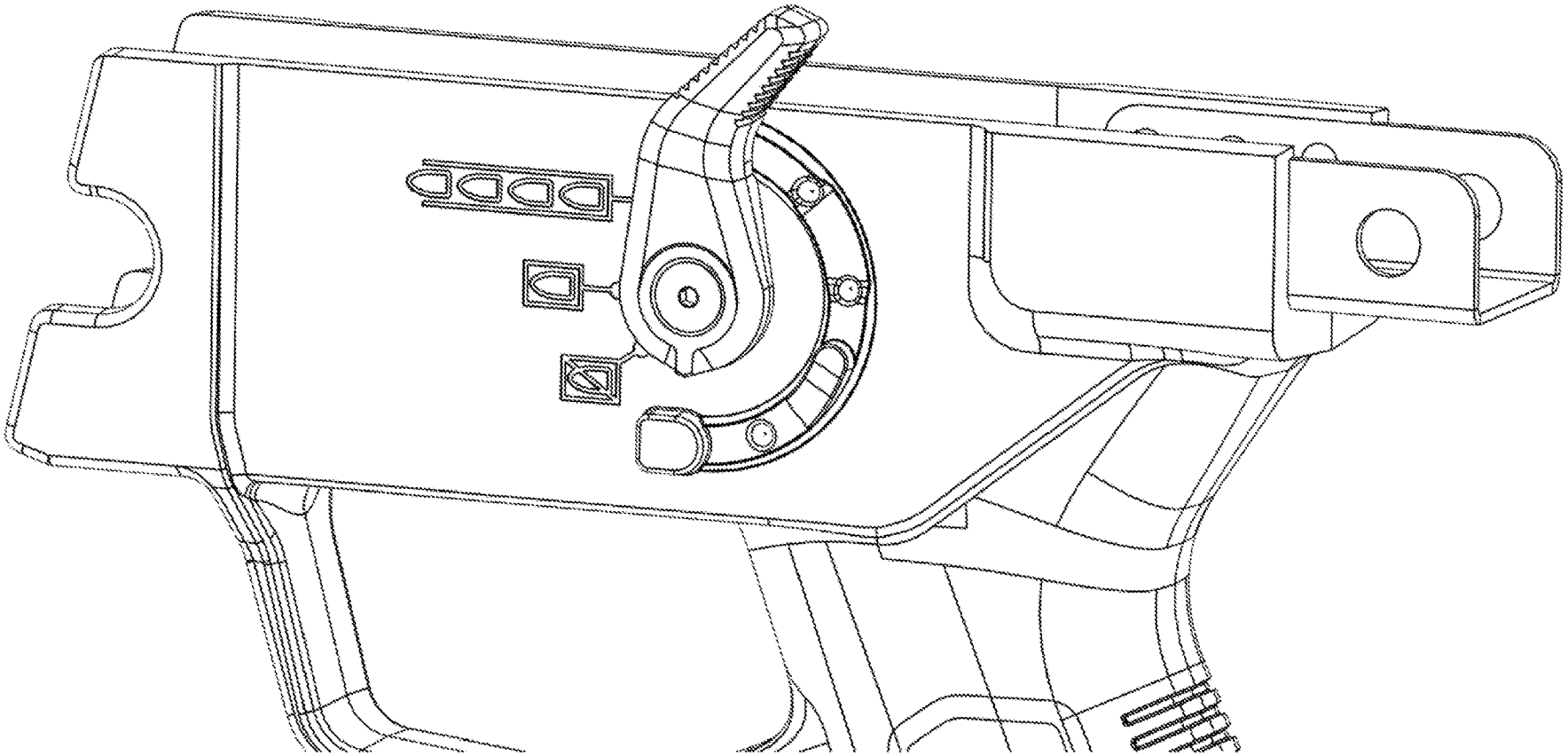
FIG. 14 illustrates the grip module with the operational mode selector lever in the disassembly position.

FIG. 14 shows the lever 124 in the disassembly position, arranged over the fourth portion 104, where the movable detent 130 is not engaged with any indentations.

The raised selector track 102 can have a curved shape, for instance following an arcing path around the selector lever aperture 122. In an embodiment, the raised selector track 102 can follow a circular path at a radius from a center of the selector lever aperture 122, where the radius is equal to a radius of the movable detent 130 from a center of the shaft 134.

Although the first, second, third, and fourth portions, 108, 112, 116, and 104 are shown as each having a single height, in other embodiments, one or more of these portions, or lengths therein, can be sloped. Such a slope would lead to a changing resistance as the lever 124 moved along such a sloping region. For instance, it may be desirable to implement second and third portions 112, 116 that slope toward the full-auto indentation 118 from the semi-auto indentation 110 as this would lead to an increasing 'helping' force that would increasingly bias the lever 124 toward the full-auto position once it passed the semi-auto indentation 110. In another embodiment, a curved (e.g., convex) shape could be used between operation mode positions. For instance, a convex shape would lead to a bias toward a position on either end of a region, and a strong bias away from the center of the region. As a specific example, if the first region were convex instead of flat, then the lever 124 would be biased toward either the safe indentation 106 or the semi-auto indentation 110 depending on the lever's 124 position.

To achieve different resistances for movement of the operational mode selector lever 124, two or more of the first, second, third and fourth portions 108, 112, 116 and 104 of the raised selector track 102 can include different heights from the outer surface 105, 107 of whichever wall 101, 103 the raised selector track 102 extends from (or both in cases where a raised selector track 102 exists on both sides of the grip module 100). For instance, the first portion of the track 108 can have a first height from the outer surface of the first or second wall 101, 103. The second portion 112 can have a second height from the outer surface of the first or second wall 101, 103. The third portion 116 can have a third height from the outer surface of the first or second wall 101, 103. The fourth portion 116 can have a fourth height from the outer surface of the first or second wall 101, 103. In an embodiment, the fourth height can be greater than the second or third heights. For instance, it may be desirable to create greater resistance to movement of the operational mode selector lever 124 into the disassembly position than the resistance to movement of the operational mode selector lever 124 into the full-auto indentation 110. The fourth height may also be greater than the first height. The second height may be greater than the first height. The third height may be greater than the first height. The third height may be greater than the second height. In an embodiment, the second and third heights can be the same. For instance, it may be desirable to create an equal resistance to movement between the semi-auto and full-auto indentations 110, 118. On the other hand, it may be desirable to create greater resistance to movement of the operational mode selector lever 124 into the full-auto indentation 118, in which case, the third height can be greater than the second height. In some embodiments, the second and fourth heights can be the same.

While reference has been made to a "raised" selector track 102, in an embodiment, the first height is zero, meaning that the first portion 108 can be flush with the surrounding outer surface 105 of the first wall 101 or the surrounding outer surface 107 of the second wall 103. None of these specific height comparisons disclosed herein are limiting, and any combination can be implemented for different purposes.

To implement the varying resistances of the different portions of the raised selector track 102, the operational mode selector lever 124 can include a movable detent 130 that is moveable toward and away from the track 102. For instance, the movable detent 130 can be coupled to an end of a flexible cantilever 132 having a fixed and a free-floating end. The fixed end can be fixed to the shaft 134, and the movable detent 130 can be fixed at or adjacent to the free-floating end. The movable detent 130 can see a spring force that increases as the movable detent 130 is forced further from the track 102. As this spring force increases, the operational mode selector lever's 124 resistance to movement along the track 102 increases. Thus, the operational mode selector lever 124 sees greater resistance when moving along portions of the track 102 having greater heights (e.g., the second, third, and fourth portions 112, 116, 104.

Figure 1:
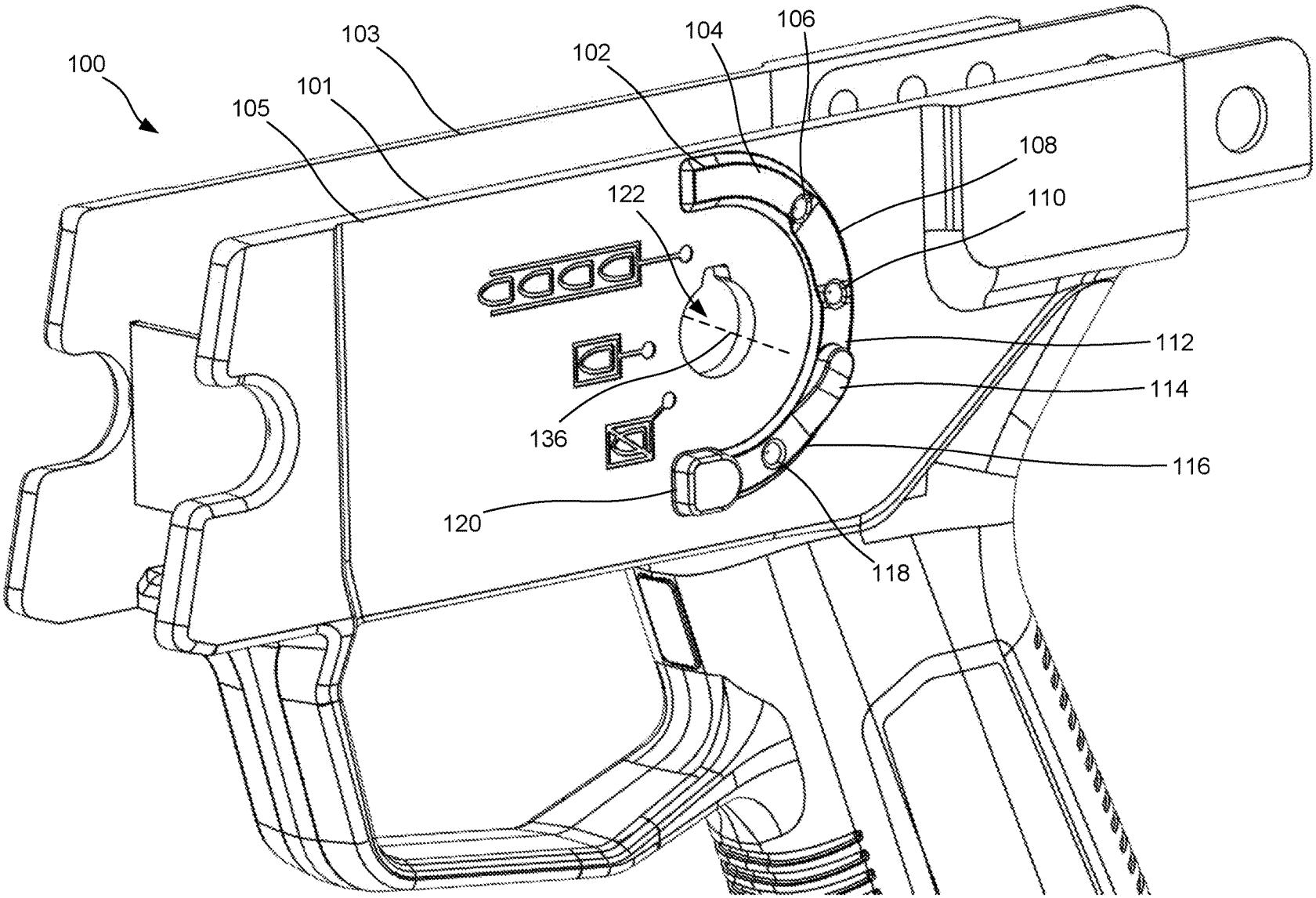
FIG. 1 shows an embodiment of a grip module having a selector track having different heights for different modes of a selector as well as a removable selector lever stop between the semi-auto and full-auto positions.
Figure 2:
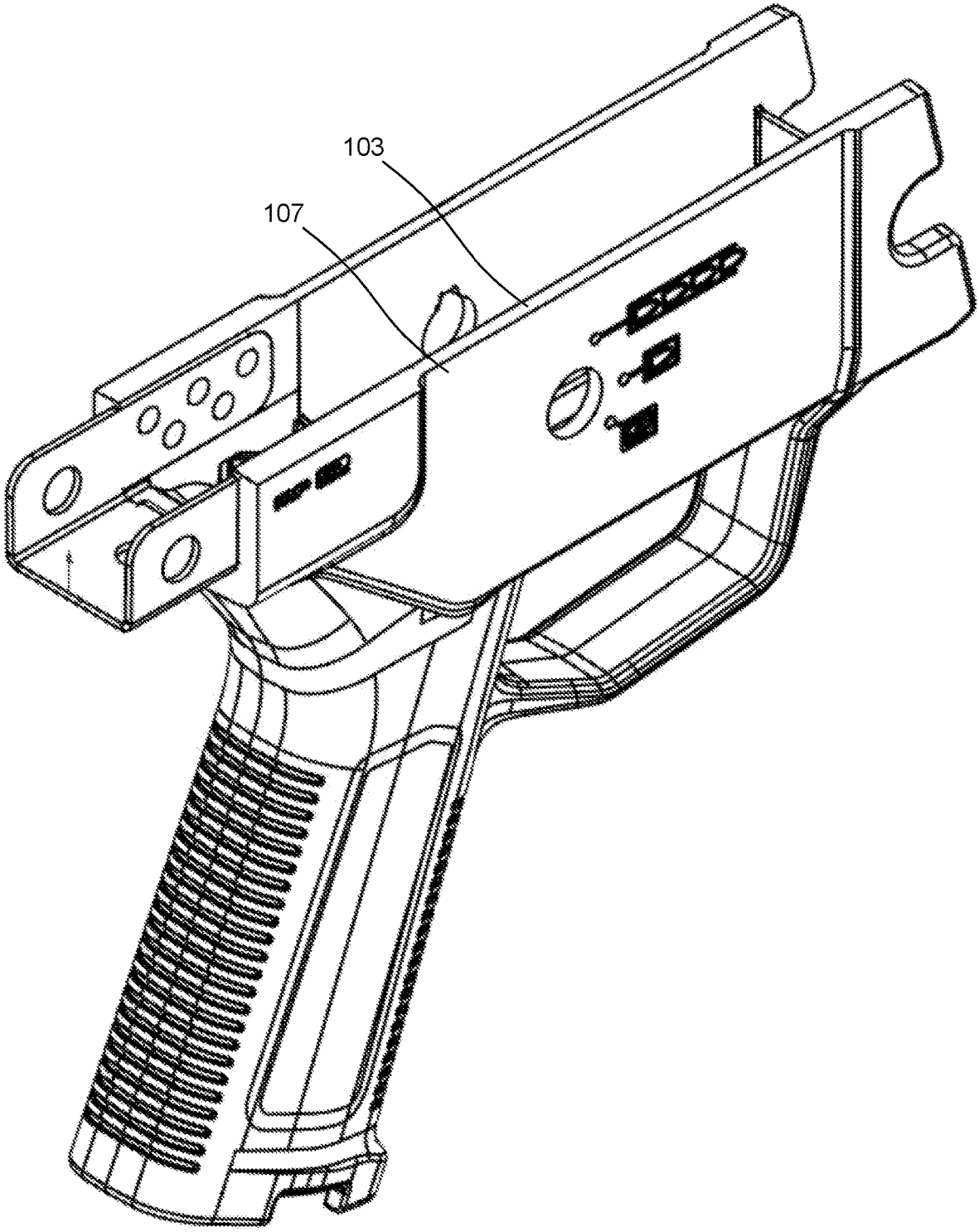
FIG. 2 illustrates a right isometric side of the embodiment shown in FIG. 1.
Figure 3:
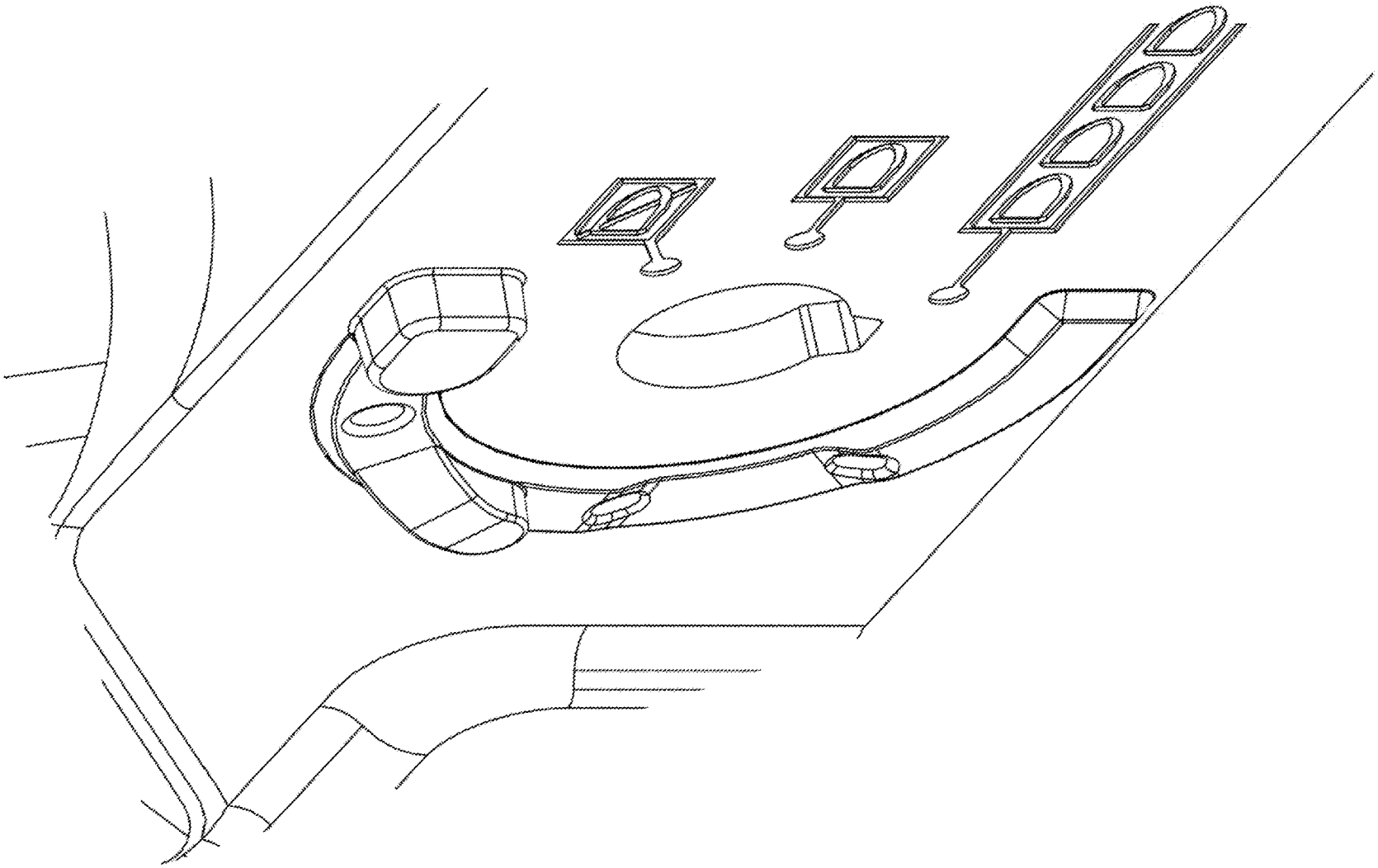
FIG. 3 illustrates a close-up angled view of the raised selector track of FIG. 1.
Figure 4:
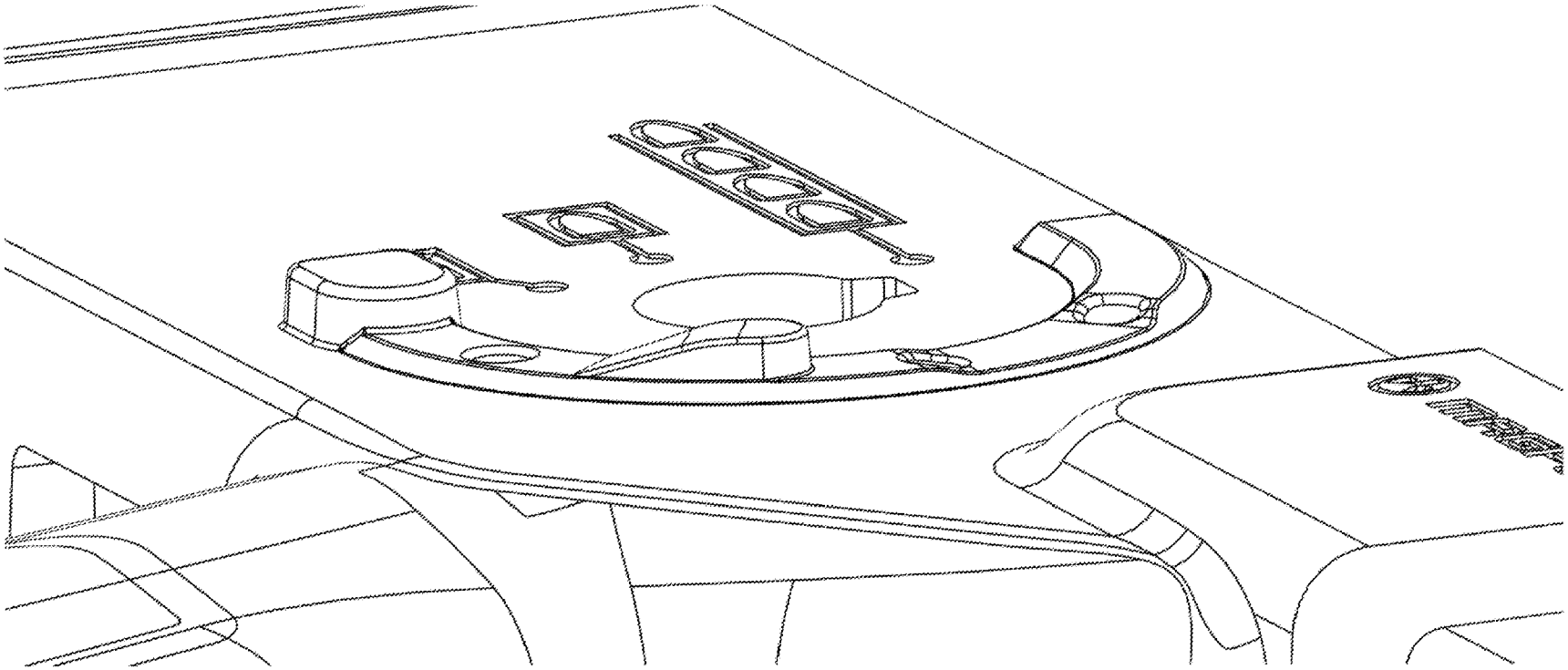
FIG. 4 illustrates another close-up angled view of the raised selector track of FIG. 1.

To secure the operational mode lever 124 in a position corresponding to a mode (e.g., safe or semi-auto), the track 102 can include indentations. For instance, the track can include a safety indentation 106 arranged between the first and fourth portions 108, 104. The safety indentation 106 can be shaped to receive at least a portion of the movable detent 130. For instance, if the movable detent 130 is spherical, then the safety indentation 106 can also be spherical, though a cylindrical indentation and select other shapes could also be implemented. A second indentation 110 can be arranged between the first and second portions 108, 112 and can be shaped to receive at least a portion of the movable detent 130. For instance, if the movable detent 130 is spherical, then the second indentation 110 can also be spherical, though a cylindrical indentation and select other shapes could also be implemented. The full-auto indentation 118 can be arranged on the third portion 116 and can be shaped to receive at least a portion of the movable detent 130. For instance, if the movable detent 130 is spherical, then the full-auto indentation 118 can also be spherical, though a cylindrical indentation and select other shapes could also be implemented. FIG. 1 shows the safety indentation 106 and the semi-auto indentation 110 as being arranged between the different portions of the track, for instance, on an angled portion transitioning between the portions. FIG. 1 also shows the full-auto indentation 118 as arranged wholly within the third portion 116. However, other locations of the indentations 106, 110, and 118 are also feasible. For instance, changing a position of the movable detent 130 within the operation mode selector lever 124 will change the position of the lever 124 for a given indentation position. In the illustrated embodiments, the movable detent 130 is roughly centered within an end of the lever 124, but in other embodiments, the movable detent 130 could be somewhat off-center in the end of the lever 124.

Figure 7:
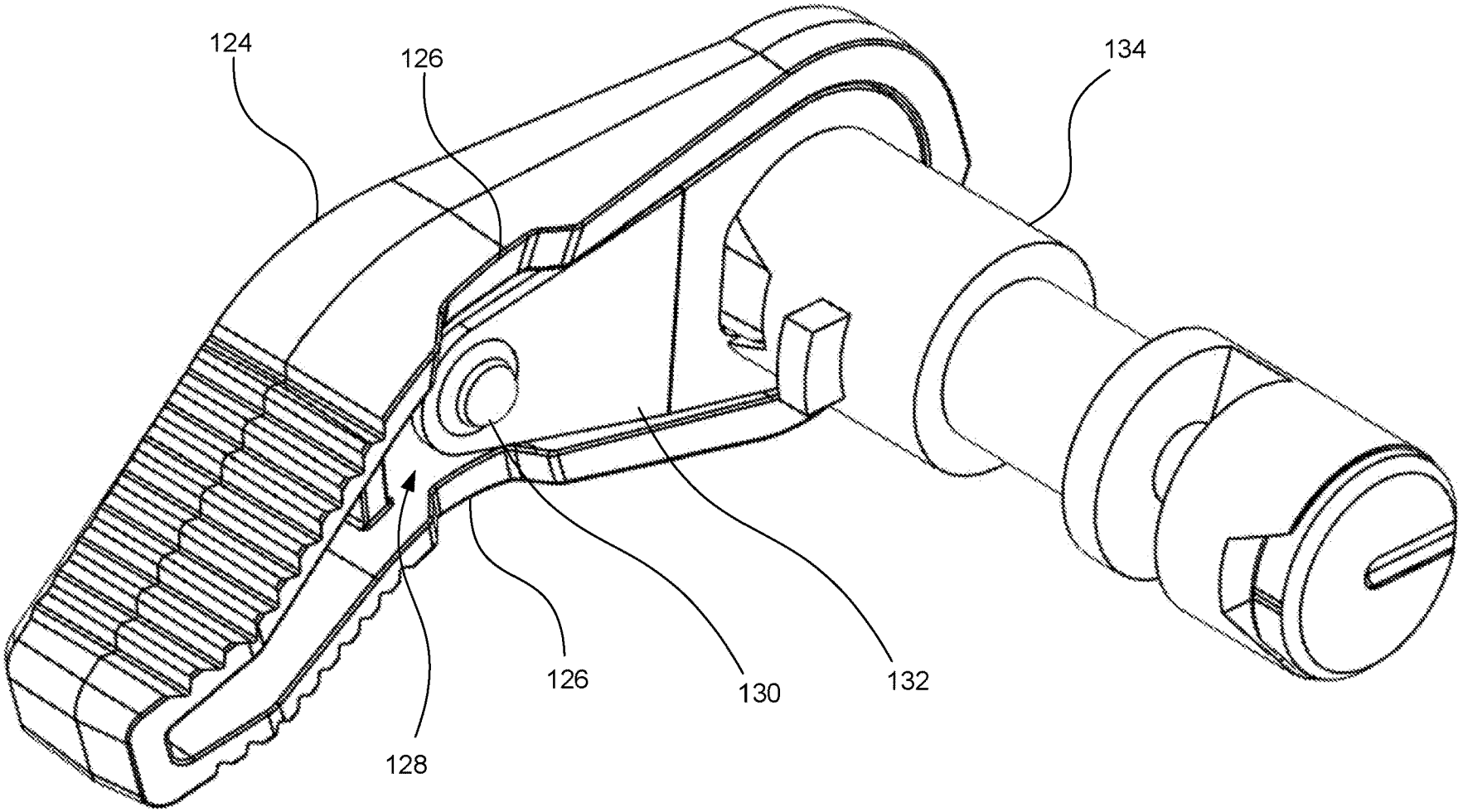
FIG. 7 illustrates a close-up view of an inside of the operational mode selector lever along with a shaft.
Figure 8A:
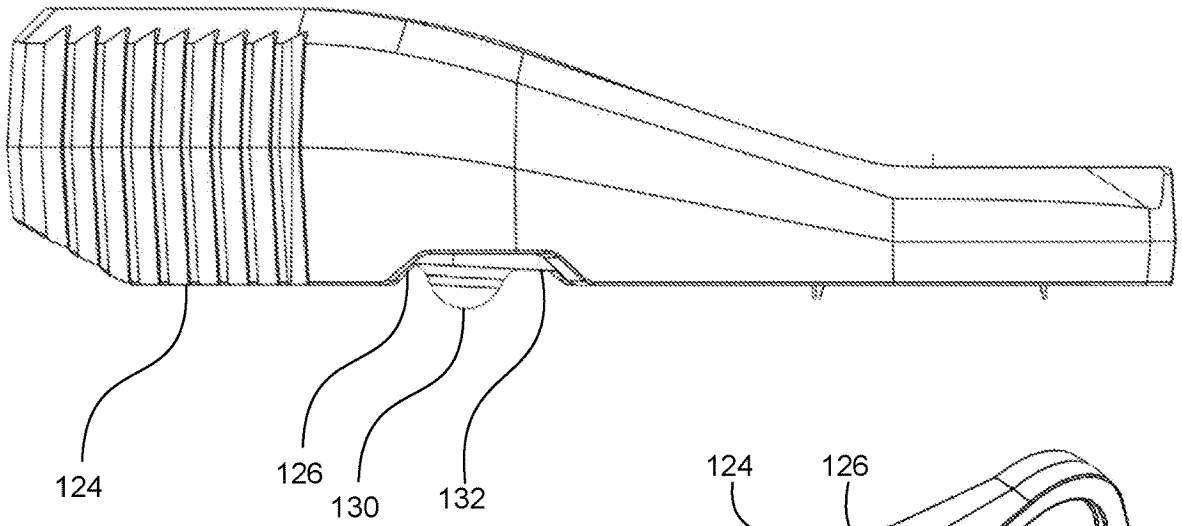
FIG. 8A illustrates a profile view of the operational mode selector lever.
Figure 8B:
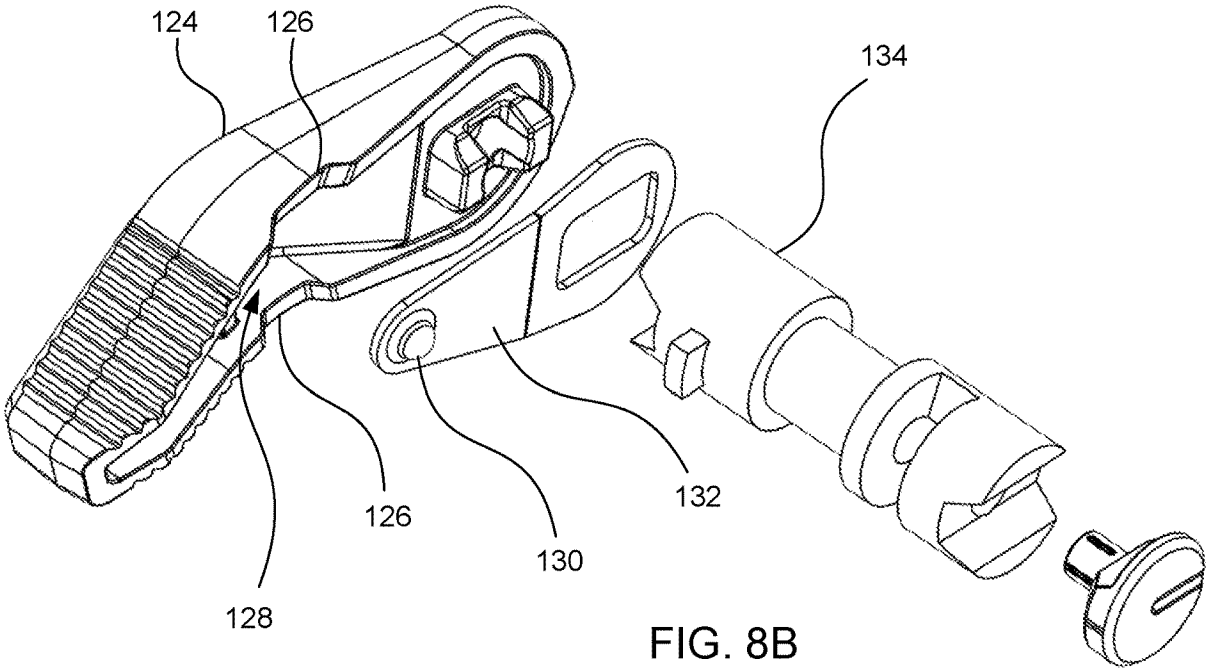
FIG. 8B illustrates an exploded view of FIG. 7.

FIGS. 6-8 illustrate details of the operational mode selector lever 124. The lever 124 can be fixed to a shaft 134, the shaft 134 including a plurality of radii configured to interface with the trigger assembly to affect different operational modes (e.g., safe, semi-auto, full-auto, slow, fast medium, etc.). The shaft 134 can couple to the lever 124 at or near a first end of the lever 124, and the shaft 134 can be configured to pass through and rotate within one or both selector lever apertures 122 (see FIG. 1). A second end of the lever 124 can rotate about a safety selector axis 136 (see FIG. 1) and can include texture for user interaction with the lever 124.

The lever can be at least partially hollow, including a hollow 128. The hollow 128 can leave walls of the lever 124 surrounding the hollow. Within the hollow 128, the movable detent 130 can be at least partially arranged. The movable detent 130 can be coupled to the shaft 134 via a flexible cantilever 132. The flexible cantilever 132 can be fixed at the shaft 134 end and free-floating at the movable detent 130 end, such that the movable detent 130 is able to move toward and away from the track 102. As the movable detent 130 moves away from the track 102, the flexible cantilever 132 bends and a spring force generated thereby increases. Thus, as the movable detent 130 is pushed away from an outer surface 105, 107 of a respective wall 101, 103 of the grip module 100 (e.g., via different heights of the track 102), the spring force generated by the flexible cantilever 132 increases and the pressure between the moveable detent 130 and the track 102 increases—thereby providing a resistive force to the user's movement of the lever 124 that increases for increasing height of a portion of the track 102.

The lever 124 can further include a track recess 126 (e.g., having a square or trapezoidal shape) in each wall of the lever 124. The track recess 126 can be shaped to allow at least a portion of the track 102 to pass through the lever 124 and interact with the movable detent 130, which may be arranged within or recessed within the hollow 128. However, in the embodiment illustrated in FIG. 8A, the movable detent 130 extends outside of the hollow 128. The track recess 126 can be aligned with the movable detent 130 (i.e., following an arcing path of the track 102).

Removable Molded-In Stop

Figure 13:
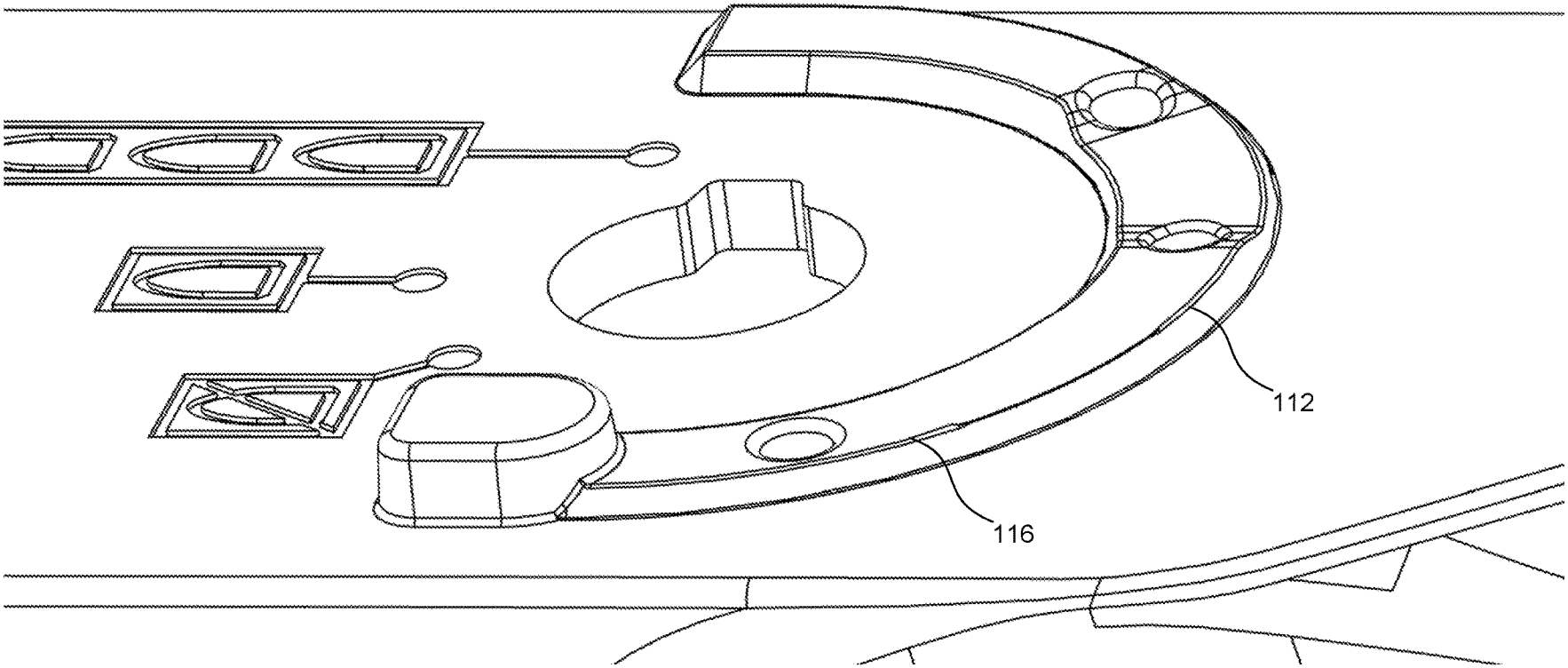
FIG. 13 illustrates a close-up of the raised selector track with the removable molded-in stop removed.

Some existing grip modules include a selector lever stop, for instance at a bottom of the semi-auto portion. Others rely on internals of the trigger assembly to prevent over-rotation past the semi-auto position. Both solutions have their disadvantages. For the built-in stop, some users replace a semi-auto trigger assembly with a full-auto trigger assembly, but then find that the over-rotation stop prevents the selector lever from being rotated to the full-auto position. As for those grip modules that do not include such a stop, the semi-auto trigger assembly often does not provide a clean tactile stop against over-rotation. This disclosure overcomes the challenges of both prior art grip modules by implementing a removable molded-in stop 114 arranged at least partially between the second portion of the track 112 and the third portion of the track 116. The removable molded-in stop 114 prevents the operational mode selector lever 124 from moving into the third portion of the track 116. However, this stop 114 can be formed from a removable material such as a polymer, such that the stop 114 can be easily cut, sanded, abraded or otherwise removed with basic shop tools. FIG. 13 shows a close-up of the track 102 with the stop 114 removed. In this embodiment, a height of the second and third portions 112, 116 is the same. Once the stop 114 is removed, the operational mode selector lever 124 can move from the second portion of the track 112 to the third portion of the track 116, and this can enable full-auto firing when a full-auto trigger assembly is used. The removable molded-in stop 114 can be formed as part of the selector track 102 or can be removably affixed to the track 102 after the track 102 has been fabricated (e.g., via an adhesive or fastener(s)).

Figure 15:
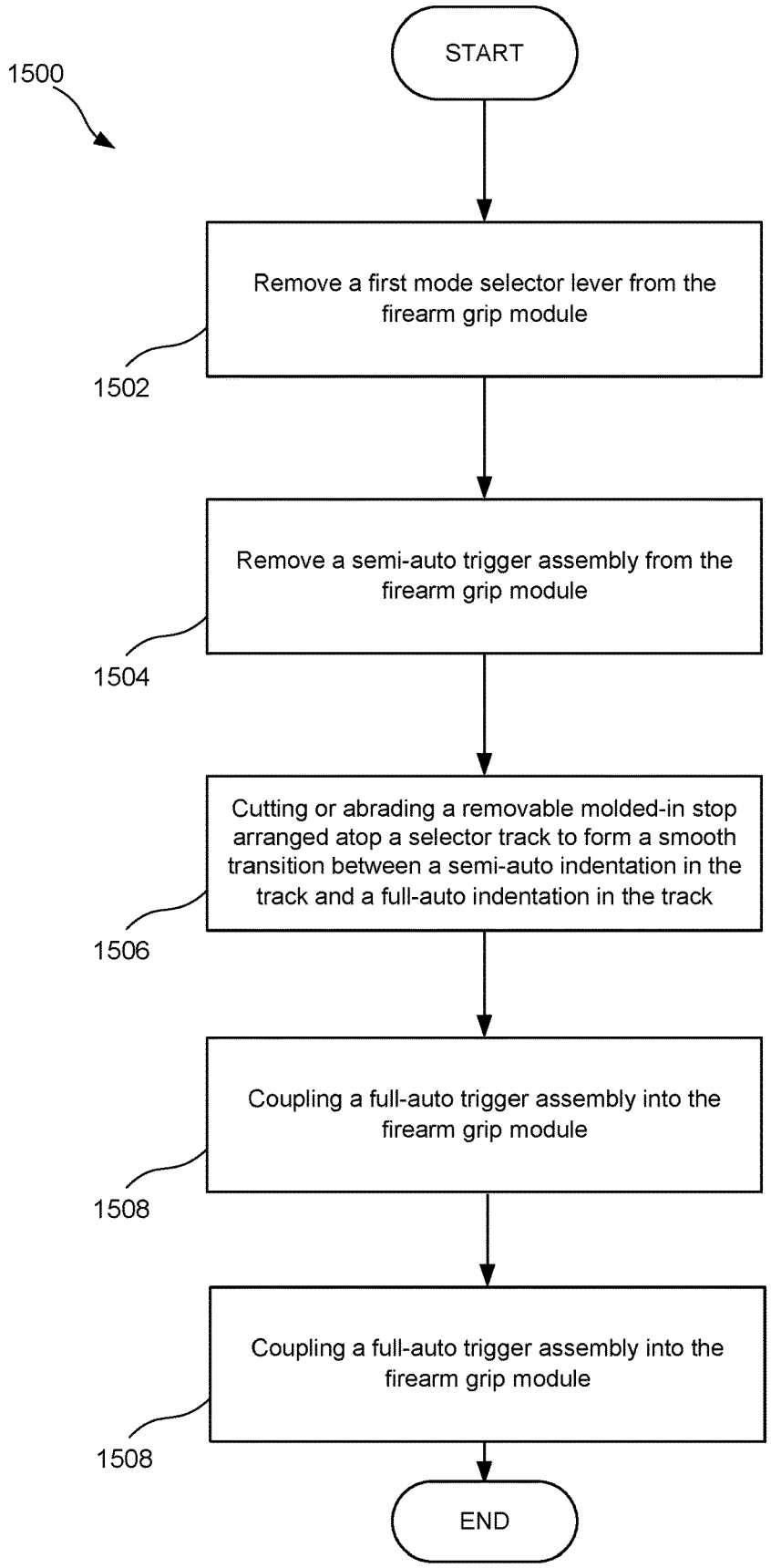
FIG. 15 illustrates a method of converting a firearm grip module from semi- to full-auto capability.

FIG. 15 illustrates a method of converting a firearm grip module from semi- to full-auto capability. The method can include removing a first mode selector lever from the firearm grip module (Block 1502). The method can further include removing a semi-auto trigger assembly from the firearm grip module (Block 1504). The method can further include cutting or abrading a removable molded-in stop arranged atop a selector track to form a smooth transition between a semi-auto indentation in the track and a full-auto indentation in the track (Block 1506). The method can yet further include coupling a full-auto trigger assembly into the firearm grip module (Block 1508) and coupling a second mode selector lever into the full-auto trigger assembly (Block 1510).

Although this disclosure has referred to a grip module 100 for a firearm, the grip module 100 could also be used in airsoft guns and other toys, air rifles, non-firearm launchers, power tools, or other gun-type tools. In other embodiments the operational mode selector lever 124 could control different operational modes of a tool or toy. For instance, the semi- and full-auto portions of the track could be replaced by single and sequential fire portions of a track for a nail gun. Additionally, this disclosure is applicable to a variety of submachine guns and various HECKLER & KOCH firearms, such as, but not limited to, roller-lock firearms, "large format pistols," (e.g., SP-89), "personal defense weapons" (e.g., MP5K-PDW), traditional sub machine guns (e.g., the MP5), carbines (e.g., the HK33), and rifles (e.g., the HK91/G3).

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A firearm grip module comprising:
an operational mode selector lever;
a first wall and a second wall forming a channel therebetween configured to receive a trigger assembly, each of the first and second walls having an outer surface;
a selector lever aperture in the first wall;
a selector track arcing concentrically around the selector lever aperture, the selector track comprising:
a first portion of the track having a first height from the outer surface of the first wall;
a second portion of the track having a second height from the outer surface of the first wall; and
a third portion of the track having a third height from the outer surface of the first wall,
a fourth portion of the track having a fourth height from the outer surface of the first wall;
wherein the fourth height is greater than the first height and the second height is greater than the first height.

2. The firearm grip module of claim 1, wherein the fourth height is greater than the second height.

3. The firearm grip module of claim 1, wherein the second and third heights are the same.

4. The firearm grip module of claim 1, wherein one or more of the portions of the track has a variable height.

5. The firearm grip module of claim 4, wherein the one or more of the portions of the track is angled.

6. The firearm grip module of claim 4, wherein one or more of the portions of the track includes a curve.

7. The submachine gun grip module of claim 1, further comprising:
the fire mode selector lever comprising a movable detent;
a safety indentation arranged between the first and fourth portions of the track, and shaped to receive at least a portion of the movable detent;
a semi-auto indentation arranged between the first and second portions of the track, and shaped to receive at least a portion of the movable detent; and
a full-auto indentation arranged on the third portion of the track and shaped to receive at least a portion of the movable detent.

8. The firearm grip module of claim 1, further comprising a removable molded-in stop arranged at least partially between the second and third portions of the track.

9. The firearm grip module of claim 8, wherein the operational mode selector lever is unable to reach the third portion of the track when the removable molded-in stop is present, and is able to reach the third portion of the track when the removable molded-in stop has been removed.

10. The firearm grip module of claim 1, wherein the first height is equal to zero.

11. The firearm grip module of claim 1, wherein the first height is greater than zero.

12. A firearm grip module comprising:
a first wall and a second wall forming a channel therebetween configured to receive a trigger assembly, each of the first and second walls having an outer surface;
a first selector lever aperture in the first wall;
a selector track arcing concentrically around the selector lever aperture, the selector track comprising:
a first portion of the track having a first height from the outer surface of the first wall;
a second portion of the track having a second height from the outer surface of the first wall; and
a third portion of the track having a third height from the outer surface of the first wall,
a fourth portion of the track having a fourth height from the outer surface of the first wall;
wherein the first height is greater than the third height and the third height is greater than the second height.

13. The firearm grip module of claim 12, wherein the third height is equal to the second height.

14. The firearm grip module of claim 12, wherein the third height is greater than the second height.

15. The firearm grip module of claim 12, further comprising:
a fire mode selector lever comprising a movable detent;
a safety indentation arranged between the first and fourth portions of the track, and shaped to receive at least a portion of the movable detent;
a semi-auto indentation arranged between the first and second portions of the track, and shaped to receive at least a portion of the movable detent; and
a full-auto indentation arranged on the third portion of the track and shaped to receive at least a portion of the movable detent.

16. The firearm grip module of claim 12, further comprising a removable molded-in stop arranged at least partially between the semi-auto portion of the track and the full-auto portion of the track.

17. The firearm grip module of claim 16, wherein the removable molded-in stop is configured to prevent a fire mode selector lever from reaching the full-auto portion of the track, but allows such movement once removed.

18. The firearm grip module of claim 12, wherein the second height is equal to zero.

19. The firearm grip module of claim 12, wherein the second height is greater than zero.

20. A method of converting a firearm grip module from semi- to full-auto capability, the method comprising:
removing a first mode selector lever from the firearm grip module;
removing a semi-auto trigger assembly from the firearm grip module;
cutting or abrading a removable molded-in stop arranged atop a selector track to form a smooth transition between a semi-auto indentation in the track and a full-auto indentation in the track;
coupling a full-auto trigger assembly into the firearm grip module; and
coupling a second mode selector lever to the full-auto trigger assembly.

* * * * *